US007921730B2

(12) United States Patent
Tan

(10) Patent No.: US 7,921,730 B2
(45) Date of Patent: Apr. 12, 2011

(54) DOWNHOLE ROCK SCRATCHER AND METHOD FOR IDENTIFYING STRENGTH OF SUBSURFACE INTERVALS

(75) Inventor: Chee Phuat Tan, Kuala Lumpur (MY)

(73) Assignee: Schlumberger Technology Corporation, Sugar Land, TX (US)

( * ) Notice: Subject to any disclaimer, the term of this patent is extended or adjusted under 35 U.S.C. 154(b) by 508 days.

(21) Appl. No.: 12/068,418

(22) Filed: Feb. 6, 2008

(65) Prior Publication Data

US 2008/0184772 A1 Aug. 7, 2008

Related U.S. Application Data

(60) Provisional application No. 60/899,879, filed on Feb. 7, 2007.

(51) Int. Cl.
*G01N 19/06* (2006.01)

(52) U.S. Cl. ..... 73/784

(58) Field of Classification Search ..... 73/78–83, 73/85, 783, 784, 152.01, 152.17
See application file for complete search history.

(56) References Cited

U.S. PATENT DOCUMENTS

| | | | | | |
|---|---|---|---|---|---|
| 2,408,012 | A | * | 9/1946 | Williams | 73/152.16 |
| 3,785,200 | A | * | 1/1974 | Handy | 73/152.59 |
| 3,872,717 | A | * | 3/1975 | Fox | 73/84 |
| 3,961,524 | A | * | 6/1976 | de la Cruz | 73/783 |
| 4,075,885 | A | * | 2/1978 | Handy et al. | 73/784 |
| 4,149,409 | A | * | 4/1979 | Serata | 73/152.03 |
| 4,444,058 | A | * | 4/1984 | Ratigan | 73/834 |
| 4,461,171 | A | * | 7/1984 | de la Cruz | 73/152.59 |
| 4,686,653 | A | * | 8/1987 | Staron et al. | 340/856.2 |
| 4,911,002 | A | * | 3/1990 | Enderlin et al. | 73/152.11 |
| 5,165,274 | A | * | 11/1992 | Thiercelin | 73/152.59 |
| 5,207,104 | A | * | 5/1993 | Enderlin | 73/784 |
| 5,323,648 | A | * | 6/1994 | Peltier et al. | 73/152.17 |
| 5,416,697 | A | * | 5/1995 | Goodman | 702/9 |
| 6,349,595 | B1 | * | 2/2002 | Civolani et al. | 73/152.02 |
| 6,655,220 | B1 | * | 12/2003 | Reiffsteck | 73/824 |
| 2004/0237640 | A1 | | 12/2004 | Meister et al. | |

FOREIGN PATENT DOCUMENTS

| | | | |
|---|---|---|---|
| EP | 11578 | A1 * | 5/1980 |
| EP | 0 490 420 | A | 6/1992 |
| JP | 63 171 339 | A | 7/1988 |

* cited by examiner

*Primary Examiner* — John Fitzgerald
(74) *Attorney, Agent, or Firm* — Osha Liang LLP

(57) ABSTRACT

Disclosed are a tool and method for identifying the relative strength of subsurface intervals through which a borehole has been drilled. The tool includes a tool body capable of being moved through a borehole. The tool body has pads mounted on movable arms. Preferably the arms can be loaded independently. Each pad carries scratchers, which are pushed against the borehole wall so as to create either deep narrow or shallow wide scratches. Preferably, the scratchers comprise either a single or dual element polycrystalline compact (PDC) cutter or suitable hard, wear resistant material such as tungsten carbide or natural diamond, and are pushed against the borehole wall by resiliently loaded arms. The depth of narrow scratches is measured, for example, by two tandem powered calipers and the width of wide scratches is visualized by a borehole imager.

22 Claims, 10 Drawing Sheets

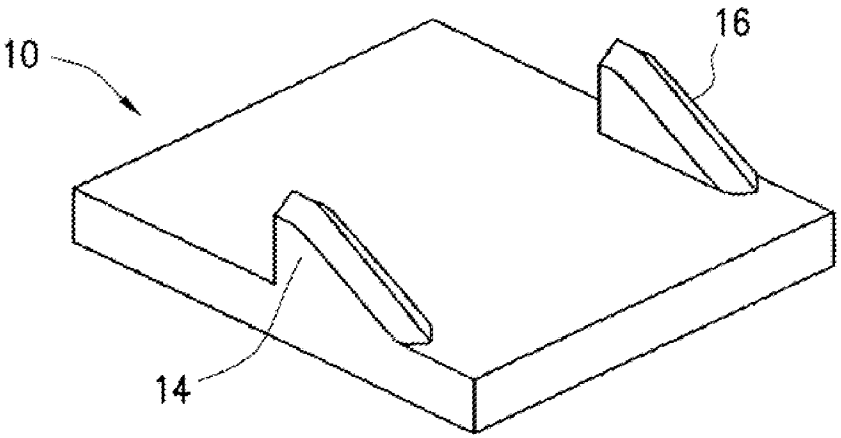
FIG. 1a
FIG. 1b
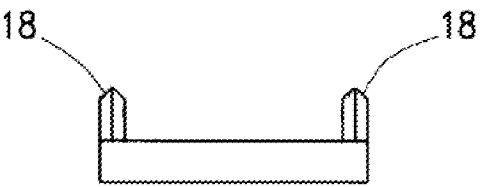
FIG. 1c

DOWNHOLE ROCK SCRATCHER AND METHOD FOR IDENTIFYING STRENGTH OF SUBSURFACE INTERVALS

CROSS REFERENCE TO RELATED APPLICATIONS

This application claims priority to U.S. provisional application No. 60/899,879, filed Feb. 7, 2007, the entire disclosure of which is hereby incorporated by reference.

FIELD OF THE INVENTION

The present invention relates to a tool and method for identifying the relative strength of subsurface intervals, typically underground formations traversed by a borehole such as a hydrocarbon well. The present invention may be employed advantageously for detecting and characterizing weak formations.

BACKGROUND OF THE INVENTION

When drilling a borehole, such as a hydrocarbon well, it is necessary to obtain information of the formations being drilled. While some information can be derived from the drilled materials returned to the surface, it is often necessary that measurements be made in-situ or on larger samples in order to obtain the necessary information. Certain properties can be measured by lowering a tool into the well and making non-intrusive measurements while the tool is moved vertically. This technique is known as electrical logging. The measurements made by the tool are returned to the surface as signals either in a wire cable or in mud pulses while drilling where they can be detected and analyzed. Consequently, the techniques are also known as wireline logging or logging/measurement-while-drilling.

Commonly measured properties relate to inherent properties of the formation such as electro-magnetic, nuclear and sonic behavior of the formation. Such measured properties allow the determination of formation resistivity, natural gamma-ray emission and sonic wave velocity. However, wireline logging and logging/measurement-while-drilling may not be able to identify weak subsurface intervals that are inter-bedded within competent formations, since the logging is typically conducted overbalance, which may mask the logging measurements of weak intervals.

In situations where identifying such weak intervals is critical, for example, to avoid running sand control by avoiding perforating the weak intervals, the approach which has been used previously includes coring the entire reservoir to retrieve rock cores. The rock cores are returned to the surface for identification of the intervals and for laboratory testing. This approach, however, is expensive and time-consuming. Further, it does not allow a continuous logging approach in which measurements are made continuously as the tool is moved along the borehole.

There is therefore a need to provide a tool which can identify weak subsurface intervals traversed by a borehole on a continuous basis and in a continuous logging operation.

SUMMARY OF THE INVENTION

According to one embodiment of the invention, a tool for identifying weak subsurface intervals through which a borehole has been drilled, comprises a tool body configured to be moved through a borehole. Mounted on the tool body is at least one scratcher that pushes against the borehole wall with a predetermined load so as to create scratches on the formations. One or more detection devices are configured to determine: (1) one or both of the depth and width of the scratches, and (2) relative strength of said formations based on the scratches.

According to one aspect of the invention, the tool body has pads mounted on movable arms. Preferably the arms can be loaded independently. Each pad carries scratchers, which are pushed against the borehole wall so as to create either deep narrow or shallow wide scratches. Preferably, the scratchers comprise either a single or dual elements, and are pushed against the borehole wall by resiliently loaded arms. The depth of narrow scratches is measured by two tandem powered calipers and the width of wide scratches is visualized by a borehole imager.

Preferably, the scratchers may comprise a polycrystalline compact (PDC) cutter or suitable hard, wear resistant material. Other possible materials may include tungsten carbide and natural diamond.

According to another aspect of the invention, the tool is adapted to be moved along the subsurface formations, and the data of the scratches are returned to surface for determining the strength index of the formations by analyzing the depth and width of the scratches.

In accordance with another aspect of the invention, a method for identifying the relative strength of subsurface intervals through which a borehole has been drilled, comprises moving the tool into a borehole and the depth and/or width of scratches in the formations made with the scratchers are analyzed.

According to a feature of the invention, measurements are made as the tool is moved along the borehole. In one embodiment, the depth of narrow scratches can be measured by two tandem powered calipers, such as a powered positioning device and caliper, and the width of wide scratches can be visualized by a borehole imager, such as an ultrasonic borehole imager or a fullbore formation microimager. Based on the analysis of the scratches, the strength index of the formations traversed by the borehole may be determined.

Other features, aspects and advantages of the invention will be apparent to those skilled in the art based on the following description of preferred embodiments.

BRIEF DESCRIPTION OF THE DRAWINGS

A more complete appreciation of the present invention and many of the advantages thereof will be more readily understood by reference to the following description when considered in conjunction with the accompanying drawings in which:

FIG. 1*a* is a perspective view of a deep narrow scratcher in accordance with an embodiment of the present invention.

FIG. 1*b* is a side plan view of the deep narrow scratcher of FIG. 1*a*.

FIG. 1*c* is a front plan view of the deep narrow scratcher of FIG. 1*a*.

DESCRIPTION OF THE PREFERRED EMBODIMENT

Figure 2A:
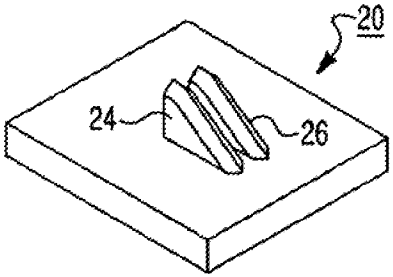
FIG. 2*a* is a perspective view of a shallow wide scratcher in accordance with an embodiment of the present invention.

The invention is described below with reference to the drawings. These drawings illustrate certain details of specific embodiments that implement the devices, systems and methods of the present invention. However, describing the invention with drawings should not be construed as imposing on the invention any limitations that may be present in the drawings. The embodiments of the present invention may be implemented using the devices specifically referenced below or equivalent devices known in the field, and may utilize an existing computer processor, or a special purpose computer processor incorporated for this or another purpose, or by a hardwired system.

Embodiments of the present invention may be practiced in a networked environment using logical connections to one or more remote computers having processors. Logical connections may include a local area network (LAN) and a wide area network (WAN) that are presented here by way of example and not limitation. Such networking environments are commonplace in office-wide or enterprise-wide computer networks, intranets and the Internet and may use a wide variety of different communication protocols. Those skilled in the art will appreciate that such network computing environments will typically encompass many types of computer system configuration, including personal computers, hand-held devices, multi-processor systems, microprocessor-based or programmable consumer electronics, network PCs, minicomputers, mainframe computers, and the like. Embodiments of the invention may also be practiced in distributed computing environments where tasks are performed by local and remote processing devices that are linked (either by hardwired links, wireless links, or by a combination of hardwired or wireless links) through a communication network. In a distributed computing environment, program modules may be located in both local and remote memory storage devices.

An exemplary system for implementing the overall system or portions of the invention might include a general purpose computing device in the form of a computer, including a processing unit, a system memory, and a system bus that couples various system components including the system memory to the processing unit. The system memory may include read only memory (ROM) and random access memory (RAM). The computer may also include a magnetic hard disk drive for reading from and writing to a magnetic hard disk, a magnetic disk drive for reading from or writing to a removable magnetic disk, and an optical disk drive for reading from or writing to a removable optical disk such as a CD-ROM or other optical media. The drives and their associated machine-readable media provide nonvolatile storage of machine-executable instructions, data structures, program modules and other data for the computer.

FIGS. 1*a-c* illustrate a deep narrow scratcher 10 in accordance with an embodiment of the present invention. In this example, the dual scratcher elements 14 and 16 are spaced apart by 26 mm and are disposed on the top surface 18 of the scratcher. As illustrated in FIG. 1*c*, the scratcher elements 14 and 16 each have a beveled edge to minimize the lateral force required to create a given depth and width of scratch. In this particular example, the angle of the beveled edge is 135 degrees with respect to the vertical axis of the surface 18 of the scratcher. The scratcher elements have a sloping face 17 on the side of the scratcher element that faces the top of a borehole to guide the scratchers as they move along the borehole and to avoid the scratchers from getting stuck when they move from a weak interval to a competent interval which may change abruptly. As shown in the example of FIG. 1*b*, the scratcher edge forms a 35 degree angle with respect to the top surface. It should be appreciated, however, that the specific dimensions illustrated in this and other examples discussed herein may be modified according to particular use and application.

Preferably, the scratcher elements comprise a polycrystalline compact (PDC) cutter or other suitable hard, wear resistant material. Other possible materials may include tungsten carbide and natural diamond.

The scratcher 10 shown in FIGS. 1*a-c* utilizes dual scratcher elements 14, 16 in order to simplify test-set up. Because the scratcher elements 14, 16 of this example are spaced 26 mm apart, they do not interact with each other during testing. Alternatively, a single scratcher element may be used to create a single deep, narrow scratch.

Figure 2B:
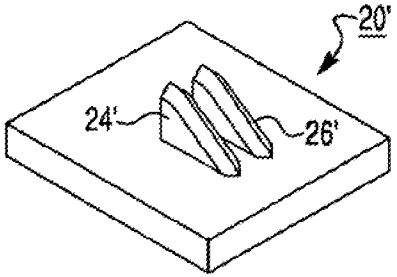
FIG. 2*b* is a perspective view of a shallow wide scratcher in accordance with an alternative embodiment of the present invention.
Figure 2C:
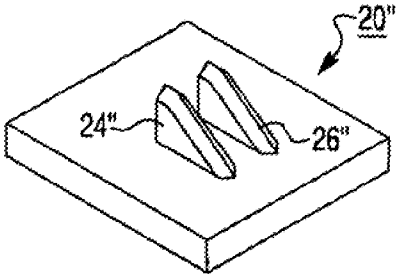
FIG. 2*c* is a perspective view of a shallow wide scratcher in accordance with another alternative embodiment of the present invention.
Figure 2D:
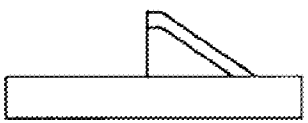
FIG. 2*d* is a side plan view of the shallow wide scratcher of FIGS. 2*a*, 2*b* and 2*c*.
Figure 2E:
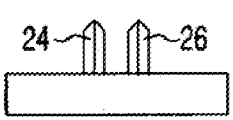
FIG. 2*e* is a front plan view of the shallow wide scratcher of FIG. 2*a*.
Figure 2F:
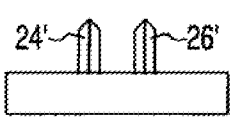
FIG. 2*f* is a front plan view of the shallow wide scratcher of FIG. 2*b*.
Figure 2G:
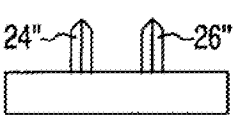
FIG. 2*g* is a front plan view of the shallow wide scratcher of FIG. 2*c*.

FIGS. 2*a*-2*c* illustrate three shallow, wide scratchers 20, 20', 20" configured to create wide scratches by the interaction of two spaced apart scratcher elements 24, 26, 24', 26', and 24", 26". The dual scratcher elements loosen materials between them and require a much lower lateral force in comparison with a single solid scratcher to create a given scratch width. As illustrated, the dual scratcher elements 24, 26 of FIG. 2*a* are spaced apart by 3 mm (FIG. 2*e*), the dual scratcher elements 24', 26' of FIG. 2*b* are spaced apart by 5 mm (FIG. 2*f*), and the dual scratcher elements 24", 26" of FIG. 2*c* are spaced apart by 7 mm (FIG. 2*g*).

Figure 3A:
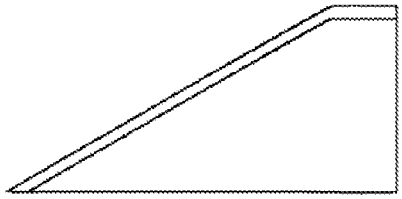
FIGS. 3*a* and 3*b* are respective side and front plan views illustrating a mounting configuration of a scratcher on a pad in accordance with an embodiment of the present invention, which in this particular illustrative example utilizes 3 mm thick scratcher elements configured for use with a 12¼" hole and an 8½" hole.
Figure 3B:
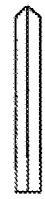
Figure 3C:
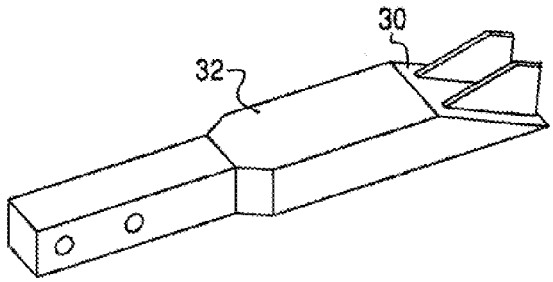
FIGS. 3*c* and 3*d* are respective perspective and front plan views of a dual scratcher on a pad in accordance with an embodiment of the present invention, which in this particular illustrative example utilizes 3 mm thick scratcher elements configured for use with a 12¼" hole.
Figure 3D:
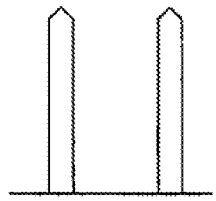
Figure 3E:
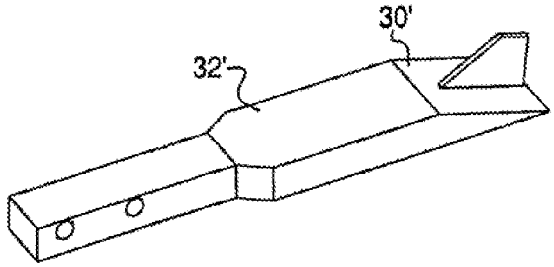
FIGS. 3*e* and 3*f* are respective perspective and front plan views of a single scratcher on a pad in accordance with an embodiment of the present invention, which in this particular illustrative example utilizes 3 mm thick scratcher elements configured for use with a 12¼" hole.
Figure 3F:
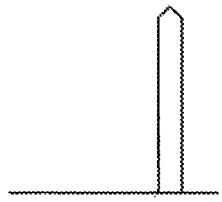

FIGS. 3*a*-3*f* and 4*a*-4*d* illustrate embodiments of a scratcher. As illustrated in FIG. 3*c*, the scratcher is mounted on a caliper pad 32.

Figure 4A:
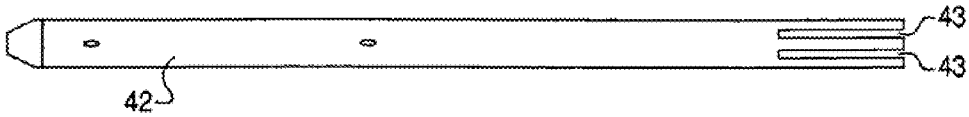
FIG. 4*a* is a top plan view of a pad for dual scratcher in accordance with an embodiment of the present invention, which in this particular illustrative example utilizes 2 mm thick scratcher elements configured for use in a 12¼" hole and in an 8½" hole.
Figure 4B:
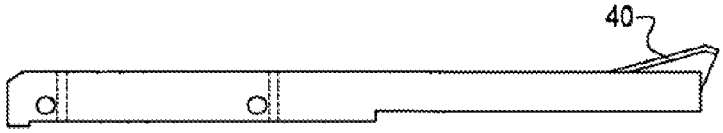
FIG. 4*b* is a side plan view of the dual scratcher mounted on a pad illustrated in FIG. 4*a*.
Figure 4C:
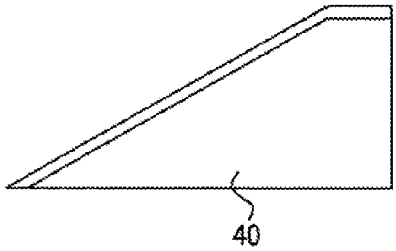
FIG. 4*c* is an enlarged side plan view of one of the scratchers of FIG. 4*b*.
Figure 4D:
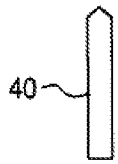
FIG. 4*d* is an enlarged front plan view of one of the scratchers of FIG. 4*b*.

As shown, the scratcher geometry preferably is different between the tools for holes of different diameters, e.g., 12¼" and 8½" holes in order to ensure that the scratcher axis is parallel to the borehole wall. For example, as shown in FIG. 4*b*, the angular orientations of the scratchers 30, 30' vary according to the diameter of the borehole. FIG. 4*a* illustrates a pad 42 for dual scratcher 40 of 2 mm thick and configured for use in a 12¼" hole and an 8½" hole. As shown in FIG. 4*a*, the pad 42 includes slots 43 to receive the scratchers.

In these examples, the pads are configured to connect to the arm of a powered positioning device and caliper, which applies a lateral force and presses the pad and scratcher against the borehole wall as the tool is moved along the borehole. The scratchers make scratches along the borehole with a predetermined load.

Figure 5:
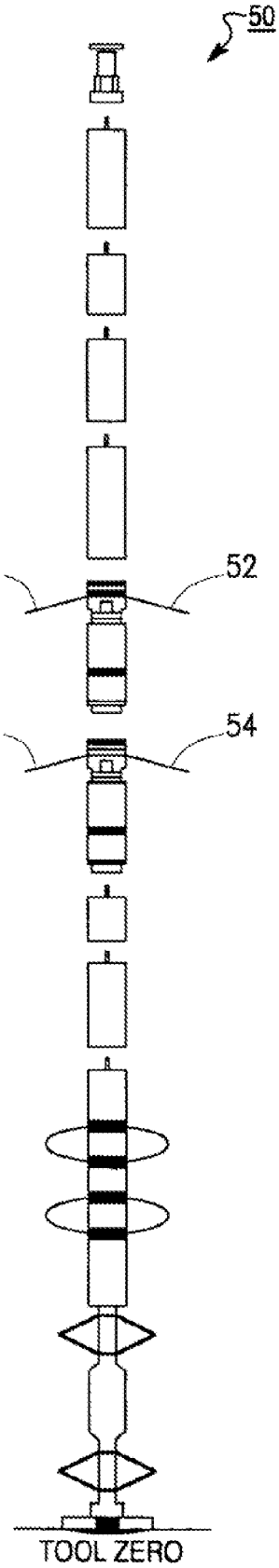
FIG. 5 is a schematic diagram of a downhole rock scratcher tool string in accordance with an embodiment of the present invention, which utilizes two powered positioning devices and calipers and one ultrasonic borehole imager device.
Figure 6:
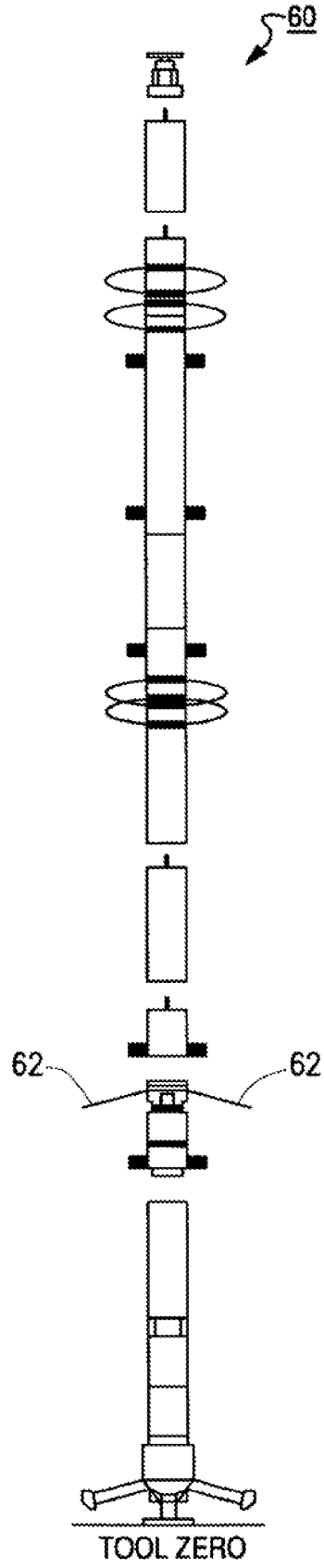
FIG. 6 is a schematic diagram of a downhole rock scratcher tool string in accordance with another embodiment of the present invention, which utilizes one powered positioning device and caliper and one fullbore formation microimager.

FIGS. 5 and 6 are schematic diagrams showing tools 50, 60 used to measure electrical properties of a formation. The tools 50, 60 comprise a central main body tool, which can be lowered into borehole by means of a wireline, which supplies power to the tool and enables data to be returned to the surface according to techniques known in the art. The tool is provided with powered positioning devices and calipers on which the arms are mounted the pads with scratchers according to the invention. Preferably, the arms can be individually loaded and operated to move the pads away from the tool body and press them against the borehole wall so they exert a predetermined load such that measurements can be made. The scratcher is mounted on the pad such that when the pad is pressed against the borehole wall and the tool is pulled up by the wireline, the scratcher is constrained to create a scratch within certain limits, in this particular example, up to 10 mm in depth and up to 15 mm in width, and one ultrasonic borehole imager device or one fullbore formation microimager is utilized.

In the embodiment of FIG. 5, the tool includes two tandem powered positioning devices and calipers 52 and 54 and one ultrasonic borehole imager. The calipers of the top powered device and caliper 52 are loaded sufficiently to keep them open, whereas the lateral force in the calipers of the bottom powered positioning device and caliper 54 is set to the maximum capacity in a centralizing position. Preferably, a swivel joint is incorporated in the tool string to prevent rotation of the powered positioning devices and calipers so as to eliminate or minimize the scratch depth measurement uncertainties due to variability of wellbore geometry. In this example, a pair of single scratchers is mounted on the diametrically opposed short calipers and a pair of dual scratchers is mounted on the diametrically opposed long calipers. The depth of the deep narrow scratches is determined from the measurements of the two tandem powered positioning devices and calipers, and the width of the shallow wide scratches is visualized by the ultrasonic borehole imager. Such visualization is accomplished according to techniques known in the art.

FIG. 6 illustrates a tool according to an alternative embodiment, which includes one powered positioning device and caliper 62 and one fullbore formation microimager run in full coverage mode. In this example, the calipers of the powered positioning device and caliper are aligned with the fullbore formation microimager pads. High torque of the calipers minimizes tool rotation. The lateral force in the calipers of the powered positioning device and caliper 62 is set to the maximum capacity in a centralizing position. The depth of deep narrow scratches may be determined from the powered positioning device and caliper 62 and fullbore formation microimager measurements, and the width of shallow wide scratches is visualized by the fullbore formation microimager.

It will be appreciated that the depth of narrow scratches and the width of wide scratches decrease with increases in the formation strength index, i.e. formation strength. Thus, by measuring one or both of the depth of narrow scratches and the width of wide scratches, it is possible to measure formation strength. By use of a tool incorporating scratchers of the invention, it is possible to determine formation strength continuously as the tool is moved along the borehole.

The tools shown in FIGS. 5 and 6 are adapted to be moved vertically through a borehole by means of wireline or slickline. However, it will be appreciated that the tool could also be run in a highly inclined well or a horizontal well on coiled tubing, drillpipe, tractor and shuttle device on an anchored tool.

Additionally, it will be appreciated that various other modifications to the tools may be implemented. For example, it may be advantageous to monitor the actual force of the pad on the borehole and/or to monitor the response signal required to maintain a constant pad force.

Figure 7:
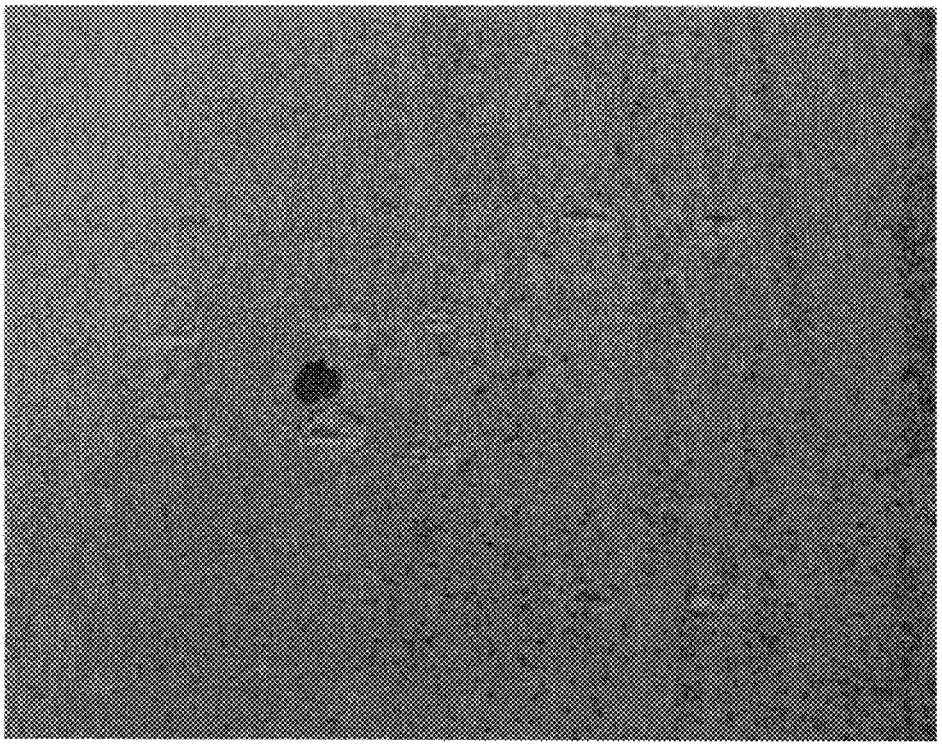
FIG. 7 is an image of scratches generated on a competent rock with scratchers according to an embodiment of the present invention.
Figure 8:
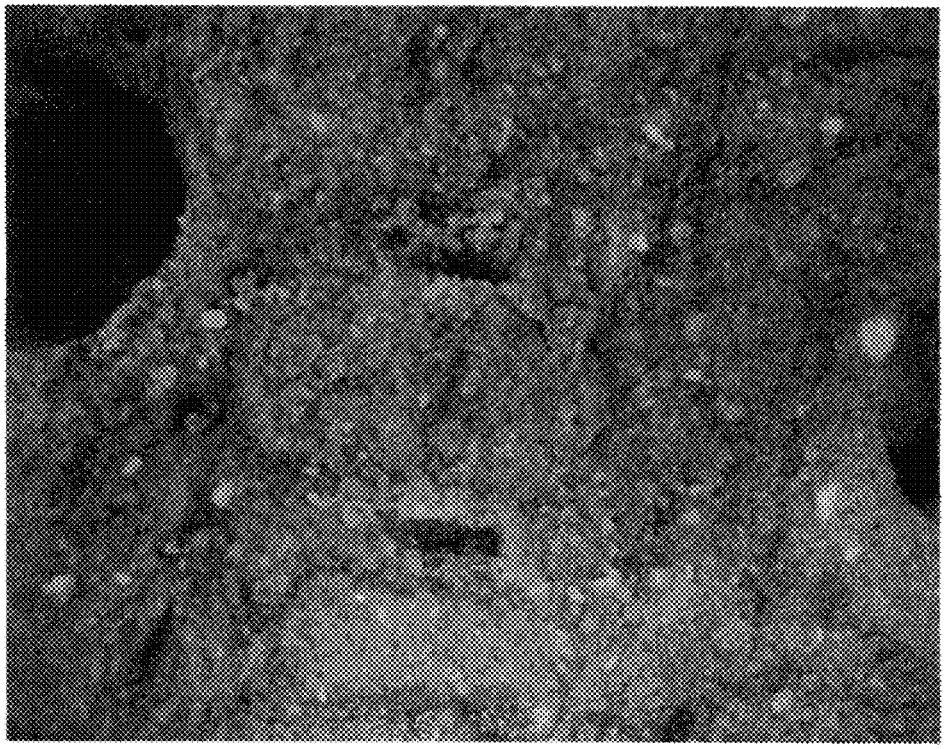
FIG. 8 is an image of scratches generated on a weak rock with a scratcher according to an embodiment of the present invention, in which the scratcher elements are spaced by 26 mm.
Figure 9:
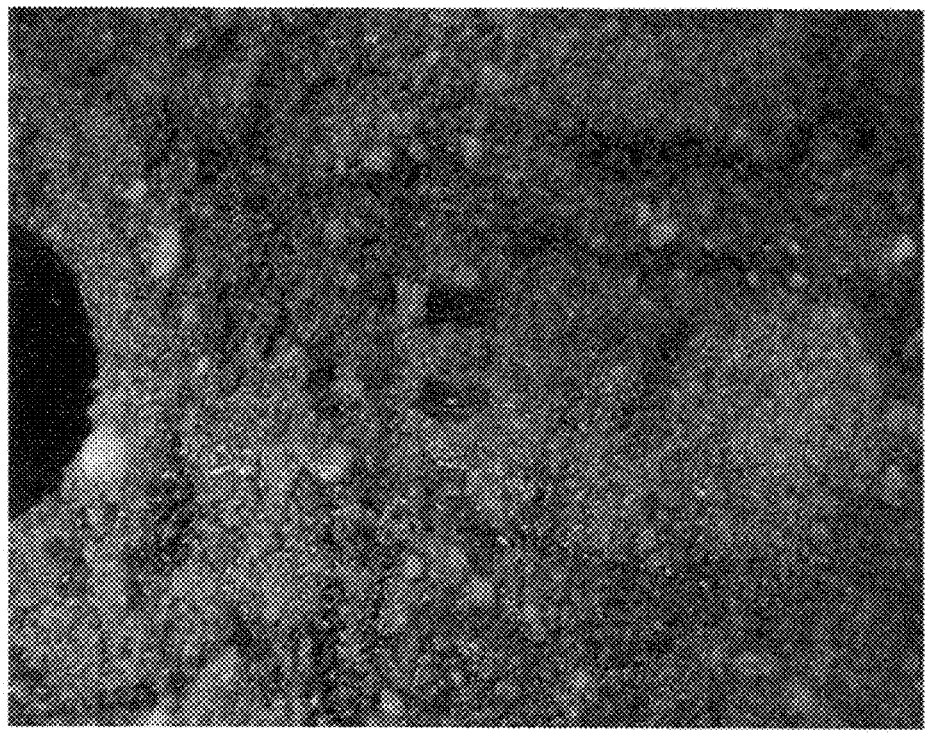
FIG. 9 is an image of scratches and loosened materials between dual scratchers generated on a weak rock with a first scratcher according to an embodiment of the present invention, in which the dual scratchers are spaced apart by 5 mm.

A series of laboratory tests is conducted in the development of the tool. These tests are conducted at atmospheric pressure in a loading frame. The scratches are made in the top surface of both the weak and competent core materials by pressing the scratches up to a range of load limits. FIG. 7 shows the shallow scratches generated on the competent material with the various spaced scratcher elements. FIG. 8 shows the scratches generated on the weak material with 26 mm spaced scratcher elements, which is intended to generate a single deep narrow scratch as discussed above. FIG. 9 shows the scratches generated on the weak material with a 5 mm spaced dual scratcher. It can be seen that the materials between the two scratches are loosened.

Figure 10:
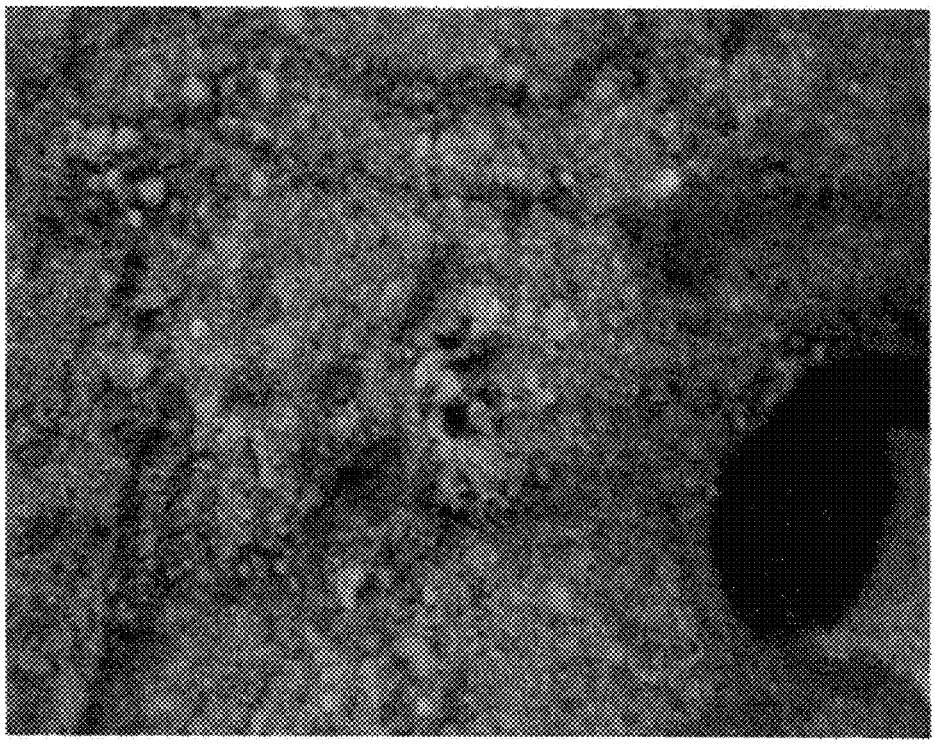
FIG. 10 is an image of scratches and loosened materials between dual scratchers generated on a weak rock with a second scratcher according to an embodiment of the present invention, in which the dual scratchers are spaced apart by 3 mm.
Figure 11:
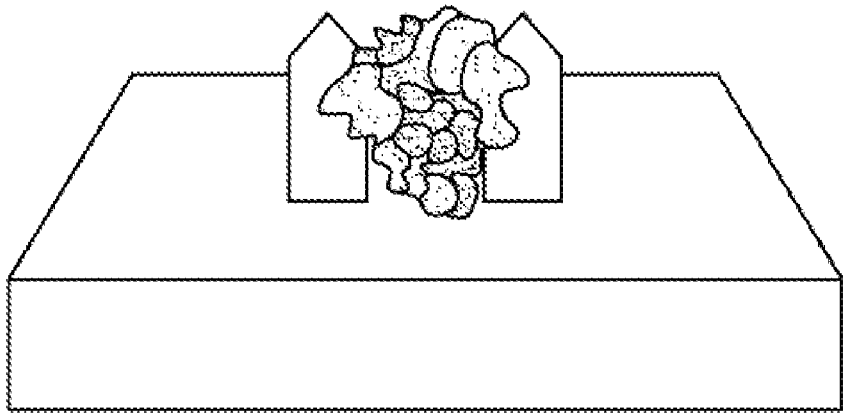
FIG. 11 is an image of loosened materials attached to a 5 mm spaced dual scratcher according to an embodiment of the present invention.
Figure 12:
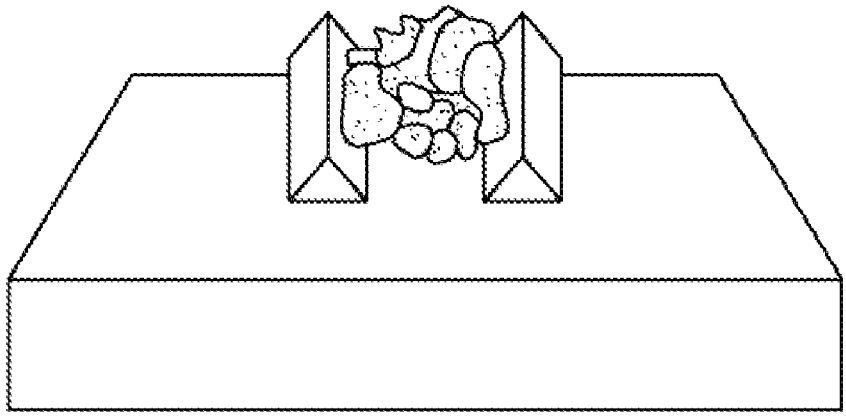
FIG. 12 is an image of loosened materials attached to a 3 mm spaced dual scratcher according to an embodiment of the present invention.

The loosening of the materials is more apparent in FIG. 10, which shows the scratches generated on the weak material with the 3 mm spaced dual scratcher. The loosened materials are attached to the scratchers as shown in FIGS. 11 and 12, which mean that they will be dislodged when the scratchers are pulled along the borehole wall.

Table 1 summarizes the test results for the competent material and two sections of the weak material, with Section 2 being weaker than Section 1.

TABLE 1

| | | Depth of Scratch (mm) | | | | |
|---|---|---|---|---|---|---|
| | | Competent | Weakly Consolidated Core (Hydraulic Oil-Wetted) | | | |
| | Load | Core (2183.6-2183.7 m) | Section 1 (2181.45-2181.55 mm) | | Section 2 (2181.1-2181.25 mm) | |
| Scratcher Type | (kN) | (Dry) | Test 1 | Test 2 | Test 3 | Test 4 |
| 26 mm spaced | 2 | 0.52 | 3.96 | 6.21 | — | — |
| scratcher | 2.8 | — | — | — | — | — |
| (3 mm thick) | | | | | | |
| 27 mm spaced | 2 | — | 6.08 | 7.22 | 7.61 (1.5 kN load) | — |
| scratcher (2 mm thick) | | | | | | |
| 7 mm spaced | 1 | 0.40 | 0.99 | — | — | — |
| scratcher | 1.4 | 0.46 | 1.4 | — | — | — |
| 5 mm spaced | 1 | 0.36 | 1.39 (LM) | 1.97 (LM) | 4.33 (LM) | 1.64 (LM) |
| scratcher | 1.4 | 0.48 | 2.63 (LM) | 2.59 (LM) | 4.95 (LM) | 2.07 (LM) |
| 3 mm spaced | 1 | 0.28 | 3.48 (LM) | 0.96 (LM) | 1.94 (LM) | 3.48 (LM) |
| scratcher | 1.4 | 0.35 | Max. Limit (LM) | 1.23 (LM) | 3.72 (LM) | 3.77 (LM) |

LM: Loosened materials

Since the pad for the single deep narrow scratch has two scratcher elements, the actual lateral force required to generate the depth of scratch is half the value shown. It can be seen that the depth of scratch in the competent material is only up to about 0.5 mm, whereas a single scratch of between 4 to 6 mm deep was generated in the weak material for a 3 mm thick scratcher, and between 6 and 7.5 mm for a 2 mm thick scratcher. For the dual scratchers, scratches of between 1 and 5 mm deep were generated in the weak material. In this example, it appears that only the 3 and 5 mm spaced dual scratchers are applicable since the materials between the scratchers were not loosened for the 7 mm spaced dual scratcher.

Figure 13:
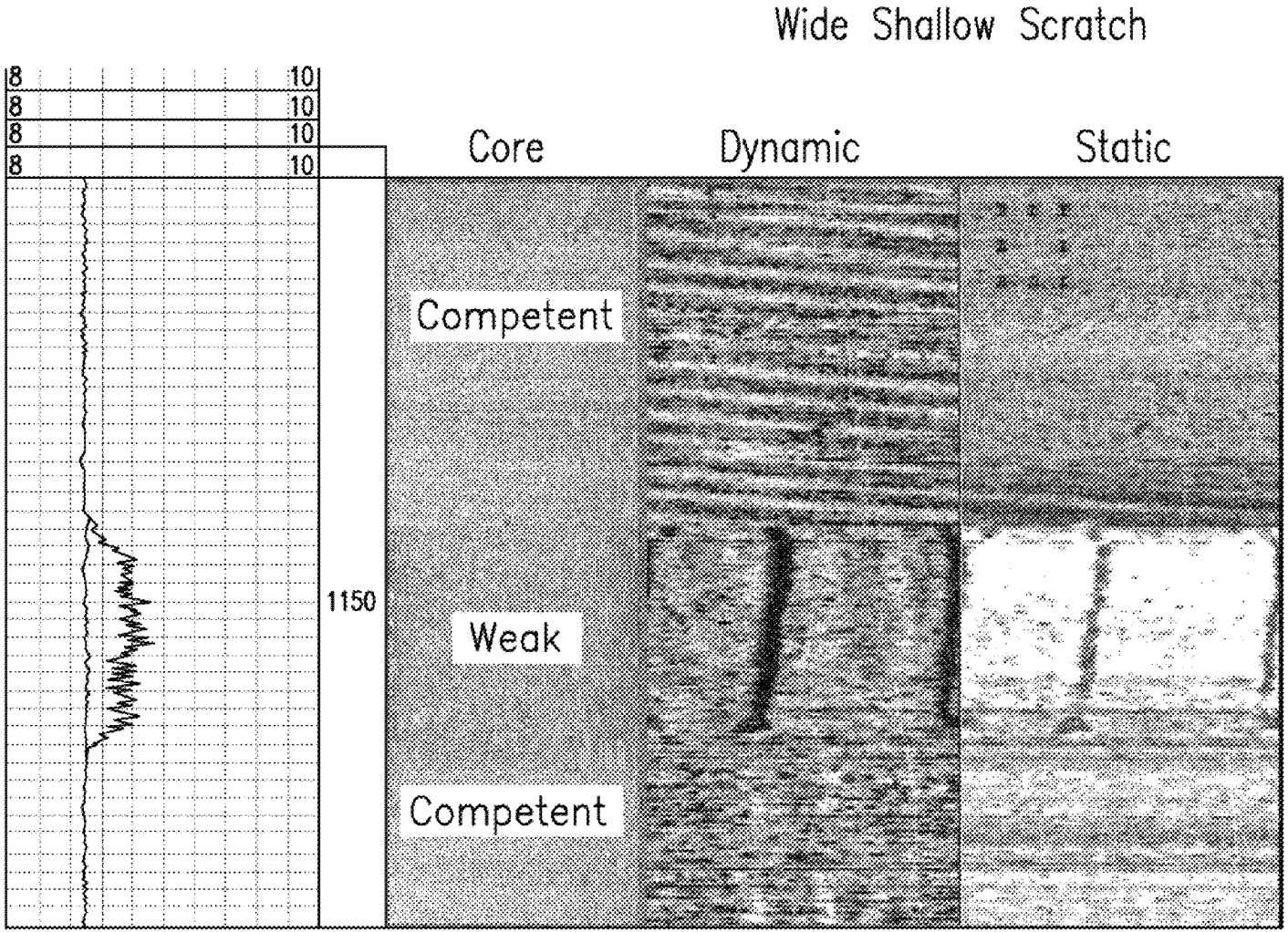
FIG. 13 shows the results of a simulated output from a tool according to an embodiment of the present invention.

FIG. 13 illustrates a simulated output from the tool of FIG. 5. There is a weak interval inter-bedded between the two competent intervals. For the competent intervals, the caliper measurements with a single scratcher of both the top and bottom powered positioning devices and calipers are essentially the same, whereas the caliper measurements of the bottom powered positioning device and caliper in the weak intervals are significantly larger. The difference between the caliper measurements of the two powered positioning devices and calipers gives the depth of the scratches. Similarly, the wide shallow scratches are only visible with the ultrasonic borehole imager within the weak interval.

It will be appreciated that with the invention, it is possible to not only detect and characterize weak formations, but also to more generally characterize the strength, mechanical properties and deformation behavior of subsurface formations.

Although the present invention has been described with respect to presently preferred embodiments, it will be appreciated by those skilled in the art that many changes can be made to the tool, scratcher devices and method disclosed herein to produce a similar technique for identifying weak subsurface intervals through which a borehole has been drilled. Accordingly, all changes or modifications that come within the meaning and range of equivalency of this invention are to be embraced within their scope.

I claim:

1. A tool for identifying the relative strength of subsurface intervals of formations through which a borehole has been drilled, comprising:

a tool body configured to be moved through a borehole;

a plurality of movable arms mounted on the tool body, wherein each of the plurality of movable arms is configured to apply a lateral force independently;

a scratcher mounted on each movable arm, wherein each scratcher is configured to perform a scratch test of a section of a wall of the borehole when applying the lateral force corresponding to one of the plurality of movable arms;

a plurality of tandem powered calipers mounted on the tool body and configured to measure a depth of the scratch test; and a borehole imager mounted on the tool body and configured to measure a width of the scratch test, wherein the depth and the width of the scratch test are used to determine a relative strength of the section of the wall of the borehole.

2. The tool as claimed in claim 1, wherein the tool body and scratcher are configured to move axially along the borehole.

3. The tool as claimed in claim 1, wherein each of the plurality of tandem powered calipers and each borehole imager is configured to identify weak subsurface intervals of the formations, wherein the weak surface intervals of the formations comprise loose rock materials along portions of the borehole.

4. The tool as claimed in claim 1, wherein at least one scratcher comprises dual scratcher elements that are mutually spaced so as to loosen rock materials in the formations.

5. The tool as claimed in claim 1, wherein the scratcher comprises a polycrystalline diamond compact cutter.

6. The tool as claimed in claim 1, wherein the scratcher comprises at least one of a group consisting of a tungsten carbide and a natural diamond cutter.

7. The tool as claimed in claim 1, wherein the scratcher is mounted on a pad that is mounted on the movable arm.

8. The tool as claimed in claim 7, wherein the depth of the scratch test is constrained within a predetermined limit.

9. The tool as claimed in claim 1, wherein each of the plurality of tandem powered calipers are connected to a pad and the scratcher.

10. The tool as claimed in claim 9, wherein at least two of the tandem powered calipers are configured to apply a different lateral force on each corresponding scratcher that is connected thereto.

11. The tool as claimed in claim 1, wherein at least one of said scratchers is configured to create a scratch in the section of the wall during the scratch test, the scratch having a depth.

12. The tool as claimed in claim 11, wherein the depth is at least 2 mm.

13. The tool as claimed in claim 12, wherein the depth is between 2 mm and 10 mm.

14. The tool as claimed in claim 1, wherein at least one of said scratchers is configured to create a scratch in the section of the wall during the scratch test, the scratch having a width.

15. The tool as claimed in claim 14, wherein the width is at least 5 mm.

16. The tool as claimed in claim 15, wherein the width is between 5 mm and 15 mm.

17. The tool as claimed in claim 1, wherein the scratcher is configured to guide along the surface of the borehole as the tool is moved within the borehole.

18. The tool as claimed in claim 17, wherein the scratcher has a sloped face on a side facing the top of the borehole.

19. The tool as claimed in claim 18, wherein the scratcher has a scratching face and a sloping face, each with a beveled edge.

20. A method for identifying the relative strength of subsurface intervals of formations through which a borehole has been drilled, comprising:

moving a tool through the borehole, wherein the tool comprises a plurality of movable arms, wherein each of the plurality of movable arms is configured to apply a lateral force independently;

performing a plurality of scratch tests of a section of a wall of the borehole, wherein each of the plurality of scratch tests uses a scratcher mounted on one of the plurality of movable arms, wherein each of the plurality of movable arms applies a different lateral force;

measuring a depth of each of the plurality of scratch tests using a plurality of tandem calipers mounted on the tool body;

measuring a width of each of the plurality of scratch tests using a borehole imager mounted on the tool body;

determining a relative strength of the section of the wall of the borehole using the depth and the width of the plurality of scratch tests.

21. The method as claimed in claim 20, further comprising determining a strength index of said formations, wherein the strength index characterizes the hardness of rock materials along the borehole.

22. The method as claimed in claim 20, wherein measurements are made as the tool is moved along the borehole.

* * * * *